United States Patent [19]

Tatum

[11] 4,018,715

[45] Apr. 19, 1977

[54] GROUND ELECTRODE BACKFILL COMPOSITION

[76] Inventor: Joe F. Tatum, P.O. Box 1089, Hattiesburg, Miss. 39401

[22] Filed: June 29, 1976

[21] Appl. No.: 700,983

[52] U.S. Cl. ..... 252/510; 252/502; 106/307; 174/6; 204/294

[51] Int. Cl.[2] ..... H01B 1/06

[58] Field of Search ..... 252/510, 502; 204/294; 174/6; 106/307

[56] References Cited

UNITED STATES PATENTS

| | | | |
|---|---|---|---|
| 2,553,654 | 5/1951 | Heise | 174/6 |
| 3,725,669 | 4/1973 | Tatum | 174/6 X |
| 3,853,793 | 12/1974 | Brown et al. | 252/510 |
| 3,857,991 | 12/1974 | Higashimura et al. | 174/6 |

*Primary Examiner*—Benjamin R. Padgett
*Assistant Examiner*—E. Suzanne Parr
*Attorney, Agent, or Firm*—A. Yates Dowell, Jr.

[57] ABSTRACT

A low resistance backfill material for use in anode beds for cathodic protection of subsurface metallic structures. The backfill material consists of a mixture of carbonaceous materials, a lubricant, and a surfactant, which material may be mixed with water and pumped as a high density fluidized suspension into the anode bed.

8 Claims, No Drawings

GROUND ELECTRODE BACKFILL COMPOSITION

BACKGROUND OF THE INVENTION

1. Field of the Invention

The invention relates generally to backfill material for ground bed anodes and particularly to a low resistance backfill material which is a mixture of carbonaceous materials and a surfactant.

2. Description of the Prior Art

The practice of utilizing deep well anode beds to prevent corrosion and rapid deterioration of subsurface metallic structures is an effective method of increasing the life of such structures.

Under various conditions, corrosion of subsurface metallic structures has been caused by galvanic action due to the creation of anodic and cathodic areas on the metallic structures. It was found that corrosion occurred at the anodic area of the structure at which areas a current flow was established from the metallic structure into the surrounding soil and water which acted as an electrolytic medium. However, the cathodic areas of the subsurface structures at which the flow of current was directed or collected from the surrounding medium to the metallic structure were found to remain relatively free from corrosive action.

In order to prevent the corrosive action at anodic areas along the subsurface structures, it was determined that various forms of electrodes could be placed in the ground in the general vicinity of the subsurface metallic structure and an electric current was impressed thereon which flowed into the surrounding soil to substantially all areas of the subsurface structure. Since the impressed current was greater than the galvanic current, such impressed current overpowered the galvanic current on the subsurface structure so that substantially the entire surface area of the structure became cathodic. In this manner, the electrode acted as an anode which became subject to electrochemical attack and the subsurface metallic structure was protected from such corrosive action as its surface was cathodic. Such a process became known in the field as "cathodic protection."

Although cathodic protection has been widely accepted, its effectiveness is a direct function of the effective life of the electrode and the impressed current used to establish current flow. Early electrodes consisted of utilizing metallic pipes, rails, beams and various scraps which were buried in the ground adjacent the subsurface structure to be protected and supplying an electric current to such members. However, as such electrodes were subject to corrosive effects, their maximum effective life was dependent upon the weight of the material, the amount of current used, and the soil conditions including soil acidity and moisture content.

In use such electrodes tended to separate along areas of localized corrosion and therefore portions of the electrode were removed or separated from the current supply. Such localized corrosion substantially decreased the effective life of the electrode resulting in an effective life range of between 4 to 8 years, again dependent upon the various conditions mentioned above. Therefore, various carbon and graphite electrodes have also been widely used in order to provide continuous cathodic protection. However, it is necessary to replace the expended electrodes with new ones, a process which adds to the expense of maintaining such a system.

From the above, it is apparent that in order to increase the economical operation of a cathodic protection system, it is desirable to utilize electrodes having a very low rate of consumption in terms of pounds of electrode per ampere per year. Further, the cost of electrode replacement is an important consideration.

As discussed above, the rate of consumption of the anode material was subject to various factors including possible localized separation. In this respect, it was noted that the rate of consumption was dependent upon the current density at the interface between the anode and the medium surrounding the same. In order to provide or establish a more uniform flow of current from the anode to the electrolyte, use was made of a uniformly low-resistance backfill material to completely surround the anode. Materials including granular or pulverized carbon substances such as calcined coke, graphite and the like were used not only to provide a uniformly low-resistance medium, but also to effectively decrease the electrical resistance between the anode and the electrolyte. As discussed in U.S. Pat. No. 2,553,654 to Heise, the use of such backfill permitted a significantly increased current density along the anode.

At high rates of current flow, however, and especially when water has seeped into the backfill material, hydrogen gas may be formed along the anode. If the gas cannot escape, pockets of hydrogen are formed along the anode and act as insulating barriers. Therefore, the type of backfill used and configuration of the anode bed should be such as to insure that any gas created by electrochemical action may freely escape from the anode bed.

Further, as discussed in applicant's prior U.S. Pat. No. 3,725,669, the backfill material for an earth anode bed ordinarily is placed in the bed by fluidizing the backfill with water and pumping the same into the anode bed. Such fluidizing backfill material also permits ease of anode replacement, again as described in applicant's aforementioned patent. Therefore, it is advantageous to provide a backfill material which is not only very low in resistance to current flow, but one which is easily pumped with water and which is quickly settleable therefrom to provide a dense backfill medium for an emplaced anode.

Heretofore, although carbonaceous backfill materials have been used to provide a low resistance medium to insure even current flow from an earth anode and permit increased current diversities along the surface of the anode, the placement of such backfill in the anode bed has not been as efficient as is possible.

Other examples of the prior art include U.S. Pat. No. 3,857,991 to Higashimura et al. and applicant's product bulletin LORESCO.

SUMMARY OF THE INVENTION

The present invention is embodied in a low resistance backfill material for ground bed anodes in which the backfill material includes a mixture of particulate calcined fluid petroleum coke, graphite, and a surfactant which material is mixed together and combined with water for introduction into an anode bed. The backfill material settles rapidly under water to provide a dense compact mass having a high pressure coefficient in contact with the electrodes to provide low resistance flow paths while permitting hydrogen and other insulating gases to escape.

It is an object of this invention to provide a low resistance backfill for an earth anode bed in which the surfaces of the carbonaceous material are uniformly wetted and have a high slippage factor when mixed with water so that the mixture may be easily pumped into the anode bed using a minimum amount of water.

It is a further object of this invention to provide a low resistance backfill material for an anode bed which may be pumped into the anode bed utilizing a fluid carrier and such backfill material settles in a dense compact mass having a high pressure coefficient so that a minimum amount of backfill settling and shifting occurs after placement.

DESCRIPTION OF THE PREFERRED EMBODIMENT

It has been found that calcined fluid petroleum coke is especially advantageous for use in a backfill material due to its characteristic hard round-grain uncrushable shape. The naturally round and generally smooth surface of the coke particles permits a dense anode backfill which is in intimate contact with the anode and since the coke is substantially solid carbon, it insures low resistance that causes most of the electrolytic discharge to occur along the periphery of the backfill while being sufficiently permeable to allow any gas created along the length of the bed to escape freely through the interstices between the particles.

Use has been made of particles of calcined fluid petroleum coke in sizes ranging from dust up to one-half inch. The larger particles, however, may present some difficulty in backfill placement operations, especially when using conventional pumping equipment. Additionally such larger particles have a tendency to form a bridge between the sides of the bore hole and the electrodes or anodes and form open pockets. Although the larger particles alone provide a lower resistance backfill medium than smaller particles because of fewer contact points, such larger particles are not as dense as particles capable of passing a number 16 sieve. Accordingly, the large size particles are used primarily for surface beds.

When conventional pumping equipment is used to supply the backfill to an anode bed, a piston type pump may be used to pump material having a particle size below 16 mesh into a deep anode bed and a screw type pump may be used to pump larger particles up to ½ inch in diamter.

In order to increase the ease of pumping, as well as to increase the density of the backfill material and the pressure coefficient in a deep anode bed, carbon lubricants such as natural flaking graphite or the like may be mixed with the calcined fluid petroleum coke to provide a pump lubricant and to increase the slippage factor of the coke. Although the graphite partially fills the interstices between the coke particles and increases the density of the mixture, such graphite tends to increase the resistance to electrolytic flow because of increased contact points between particles. Additionally, the graphite is substantially more expensive than the calcined coke and, therefore, it is desirable to add only enough graphite particles to the coke to obtain the benefits thereof.

In an effort to further increase the ease and economy of pumping a backfill material in a fluid medium, a surfactant is blended with various mixtures of calcined fluid petroleum coke and graphite. The surfactant acts as a wetting agent so that when a small amount of liquid such as water is added, the resultant backfill material is found to be more efficiently pumped into an anode bed than was a mixture consisting solely of the coke and graphite.

In a first example, a dry backfill material was prepared by blending a mixture of 98.00 percent by weight calcined fluid petroleum coke, 1.85 percent by weight powdered graphite, and 0.15 percent by weight of a nonionic surfactant such as polyethylene oxide. The calcined coke was of a particulate size to pass a number 16 sieve and with most of the particles passing through a 28 mesh sieve but being retained on a 40 mesh sieve. The dry backfill was pumped into a deep well anode bed by fluidizing the mixture with water utilizing a liquid to solid density of approximately 4–5 gallons of water for each 100 pounds of material. Due to the high density of solids in the fluid stream, which was enabled by the thorough wetting of the solid surfaces by the action of the surfactant agent, the backfill material was easily pumped into the anode bed utilizing a piston type pump. Further, it was observed that the solids settled more quickly and compactly in the bore hole with substantially no bridging action than was possible in a backfill mixture of the coke and graphite without the surfactant added.

In a second example, a backfill material was prepared by blending a mixture of 97.5 percent by weight calcined petroleum coke, 2.40 percent by weight powdered graphite, and 0.10 percent by weight of an anionic surfactant such as sodium lauryl sulfate. The coke and the graphite were of substantially the same particle size as the first example and the mixture was introduced into the bore hole in the same manner. The initial results were similar to the first example.

In a third example, a backfill material was prepared by blending a mixture of 98.45 percent by weight calcined petroleum coke, 1.5 percent by weight powdered graphite, and 0.05 percent by weight of a cationic surfactant such as cetyl pyridinium chloride. The coke and the graphite again were of substantially the same particle size as the first example and the mixture was introduced in the same manner. The initial results were similar to the first example.

Since it may require a period of time from 10 to 15 years before the final results may be evaluated, it is uncertain whether the different types of surfactant will give similar results or not.

Various mixtures, similar to those of the prior examples can be effectively prepared utilizing the various components in the following ranges:

| | Percent by Weight of Total Mixture |
|---|---|
| Calcined fluid petroleum coke | 97.50 – 98.45 |
| Powdered graphite | 1.50 – 2.40 |
| Surfactant | .05 – .15 |

Although the particle sizes of the calcined petroleum coke of the examples were sufficient to pass a number 16 sieve, sizes up to ½ inch in diameter may be used if a screw type rather than piston pump is used to place the backfill. Further, backfill mixtures utilizing the above components may be easily pumped utilizing from 4 to 6 gallons of water per 100 pounds of mixture dependent upon the specific formulation and particle sizes. Normally the larger the particle size, the more fluid necessary to effectively pump the backfill material into the anode bed.

In the preparation of the backfill material, the calcined fluid petroleum coke in a dry state is first sieved to size depending upon either the type of pumping equipment to be used in placing the backfill material in an anode bed or the desire to increase the relative density of the backfill by utilizing smaller particulate material. For most operations the calcined coke should be of a size so that all of the particles pass a number 16 sieve and most of such particles pass a number 28 sieve but are retained on a number 40 sieve. Such a particulate size is capable of being easily pumped using conventional pumping equipment and provides a low resistance mixture. Again, it should be noted that particle sizes up to ½ inch may be used for some applications.

After the calcined fluid petroleum coke has been sieved to size, it is blended with dry powdered graphite and a dry surfactant in varying proportions, as indicated above. The resultant dry blend or mixture is subsequently bagged and ready for delivery to a user.

When it is desired to provide a subsurface metallic structure with cathodic protection, a bore hole or other suitable excavation is first prepared which may extend from 250 to 300 feet into the ground and normally has a diameter of from 8 to 12 inches. During the drilling of the bore hole, water or other liquid normally is continuously introduced to cool the drill bit or other drilling equipment, as well as to flush earth and other displaced materials from the hole. Also, the bore hole usually extends through one or more water bearing strata. Accordingly, drilling the bore hole normally results in a bore hole filled with water or other liquid at the time that the backfill material is to be applied. After the bore hole has been dug and the drilling equipment has been removed, a filling pipe is placed in the hole with the lower end being located almost at the bottom of the hole and the upper end is connected to the pumping equipment. A first portion of the backfill material is pumped through the filling pipe into the hole after which one or more anodes are positioned within the bore hole while being supported from the surface of the earth. The remainder of the backfill is then introduced to substantially fill the bore hole and thereby completely surround the anode. The backfill is easily pumped into the bore hole through a filling pipe as a fluidized suspension by mixing water or other liquid carrier with the dry backfill in a solid to liquid ratio of 100 pounds of backfill to 4–6 gallons of water dependent upon the specific mixture used and the size of the particulate matter.

During the filling operation, the backfill material is discharged from the filling pipe adjacent to the bottom of the bore hole and is suspended temporarily in the water or other liquid in the hole. Since the backfill material has a higher specific gravity than water, most of the water in the bore hole is displaced onto the surface of the earth. After a desired amount of backfill material has been introduced, the pumping operation is discontinued and the filling pipe is removed. The backfill material immediately begins to settle to the bottom of the bore hole and within approximately 24 hours such material has settled into a dense mass having a high pressure coefficient and providing a low resistance to current flow.

I claim:

1. A backfill material for earth anode beds comprising a mixture of particulate calcined fluid petroleum coke, powdered graphite, and a surfactant.

2. A backfill material for earth anode beds comprising a mixture of the following components:

| Components | Range in Per Cent by Weight |
|---|---|
| Particulate calcined fluid petroleum coke | 97.50 – 98.45 |
| Powdered graphite | 1.50 – 2.40 |
| Surfactant | .05 – .15 |

3. The backfill material of claim 2 in which said particulate calcined fluid petroleum coke ranges in size from one-half inch in diameter to dust.

4. The backfill material of claim 2 in which said particulate calcined fluid petroleum coke is of a size to pass a number 16 sieve.

5. The backfill material of claim 4 in which a majority of the coke particles pass a number 28 sieve and are retained on a number 40 sieve.

6. The backfill material of claim 2 in which said surfactant is a nonionic surfactant.

7. The backfill material of claim 2 in which said surfactant is an anionic surfactant.

8. The backfill material of claim 2 in which said surfactant is a cationic surfactant.

* * * * *